US007143605B2

(12) United States Patent
Rohrer et al.

(10) Patent No.: US 7,143,605 B2
(45) Date of Patent: Dec. 5, 2006

(54) FLAT-TUBE EVAPORATOR WITH MICRO-DISTRIBUTOR

(75) Inventors: Clay A. Rohrer, Belle, MO (US); Ryan G. Stewart, O'Fallon, MO (US)

(73) Assignee: Hussman Corporation, Bridgeton, MO (US)

( * ) Notice: Subject to any disclaimer, the term of this patent is extended or adjusted under 35 U.S.C. 154(b) by 165 days.

(21) Appl. No.: 11/022,256

(22) Filed: Dec. 22, 2004

(65) Prior Publication Data

US 2005/0132744 A1 Jun. 23, 2005

Related U.S. Application Data

(60) Provisional application No. 60/531,818, filed on Dec. 22, 2003.

(51) Int. Cl.
*F25B 39/02* (2006.01)

(52) U.S. Cl. ..... 62/515; 165/174

(58) Field of Classification Search ..... 62/504, 62/515, 525, 527; 165/172–176
See application file for complete search history.

(56) References Cited

U.S. PATENT DOCUMENTS

| | | | | |
|---|---|---|---|---|
| 1,662,236 | A | | 3/1928 | Coupland |
| 1,845,888 | A | | 2/1932 | Rutishauser |
| 2,063,380 | A | | 12/1936 | Hoesel |
| 2,181,637 | A | | 11/1939 | Ardito |
| 2,555,055 | A | | 5/1951 | Ort |
| 2,942,858 | A | | 6/1960 | Stoneburner |
| 3,218,822 | A | | 11/1965 | Bently et al. |
| 3,289,432 | A | | 12/1966 | Brennan et al. |
| 3,303,666 | A | | 2/1967 | Toper |
| 3,397,631 | A | | 8/1968 | Simons |
| 3,524,328 | A | | 8/1970 | Schuster |
| 3,628,590 | A | | 12/1971 | Knebusch |
| 3,696,630 | A | | 10/1972 | Bressickello |
| 3,741,290 | A | | 6/1973 | Nenadal |
| 3,850,003 | A | | 11/1974 | Beckwith et al. |
| 3,976,128 | A | | 8/1976 | Patel et al. |
| 4,145,893 | A | | 3/1979 | Vogel |
| 4,370,868 | A | * | 2/1983 | Kim et al. ..... 62/504 |
| 4,474,232 | A | | 10/1984 | Wright et al. |
| 4,596,287 | A | | 6/1986 | Wissmath |
| 4,844,151 | A | * | 7/1989 | Cohen ..... 165/44 |
| 4,958,504 | A | | 9/1990 | Ichikawa et al. |
| 5,121,613 | A | | 6/1992 | Cox et al. |
| 5,157,941 | A | | 10/1992 | Cur et al. |
| 5,157,944 | A | | 10/1992 | Hughes et al. |

(Continued)

FOREIGN PATENT DOCUMENTS

| | | |
|---|---|---|
| EP | 0 710 811 | 5/1996 |

(Continued)

*Primary Examiner*—Mohammad M. Ali
(74) *Attorney, Agent, or Firm*—Michael Best & Friedrich LLP

(57) ABSTRACT

A flat-tube evaporator and a refrigeration system including a flat-tube evaporator. The flat-tube evaporator can include an inlet manifold, an outlet manifold separated a distance from the inlet manifold, a distributor tube positioned within the inlet manifold and fluidly connected to the common distributor, and a plurality of flat tubes positioned to fluidly connect the inlet manifold and the outlet manifold. The distributor tube can include a plurality of orifices, each of the plurality of orifices positioned to direct the refrigerant into the inlet manifold in a first direction. Each of the plurality of flat tubes can be positioned to direct the refrigerant from the inlet manifold to the outlet manifold in a second direction, the second direction being substantially opposite the first direction.

20 Claims, 5 Drawing Sheets

U.S. PATENT DOCUMENTS

| | | | | |
|---|---|---|---|---|
| 5,241,839 | A | 9/1993 | Hughes | |
| 5,242,016 | A * | 9/1993 | Voss et al. | 165/174 |
| 5,279,360 | A | 1/1994 | Hughes et al. | |
| 5,295,532 | A * | 3/1994 | Hughes | 165/76 |
| 5,329,988 | A | 7/1994 | Juger | |
| 5,372,188 | A | 12/1994 | Dudley et al. | |
| 5,564,497 | A | 10/1996 | Fukuoka et al. | |
| 5,579,649 | A | 12/1996 | Kim | |
| 5,584,340 | A * | 12/1996 | Derosier | 165/82 |
| RE35,502 | E | 5/1997 | Hughes et al. | |
| 5,713,215 | A | 2/1998 | Choi | |
| 5,765,393 | A | 6/1998 | Shlak et al. | |
| 5,901,565 | A | 5/1999 | Morton, Jr. | |
| 5,901,782 | A * | 5/1999 | Voss et al. | 165/144 |
| 5,910,167 | A * | 6/1999 | Reinke et al. | 62/525 |
| 5,924,297 | A | 7/1999 | Wolff et al. | |
| 5,934,367 | A | 8/1999 | Shimmura et al. | |
| 6,023,940 | A * | 2/2000 | Abbott et al. | 62/504 |
| 6,155,075 | A | 12/2000 | Hanson et al. | |
| 6,158,503 | A * | 12/2000 | Gille et al. | 165/132 |
| 6,161,616 | A | 12/2000 | Haussmann | |
| 6,167,713 | B1 * | 1/2001 | Hartfield et al. | 62/115 |
| 6,199,401 | B1 | 3/2001 | Haussmann | |
| 6,237,677 | B1 * | 5/2001 | Kent et al. | 165/110 |
| 6,301,916 | B1 | 10/2001 | Navarro | |
| 6,318,109 | B1 | 11/2001 | Reimann et al. | |
| 6,340,055 | B1 * | 1/2002 | Yamauchi et al. | 165/174 |
| 6,351,964 | B1 | 3/2002 | Brancheau et al. | |
| RE37,630 | E | 4/2002 | Behr | |
| 6,411,916 | B1 | 6/2002 | Pellerin | |
| 6,460,372 | B1 | 10/2002 | Fung et al. | |
| 6,467,535 | B1 | 10/2002 | Shembekar et al. | |
| 6,606,882 | B1 * | 8/2003 | Gupte | 62/504 |
| 6,729,386 | B1 | 5/2004 | Sather | |
| 2001/0003248 | A1 | 6/2001 | Otto et al. | |
| 2002/0162346 | A1 | 11/2002 | Chiang | |
| 2002/0179295 | A1 | 12/2002 | Palanchon | |
| 2003/0010483 | A1 | 1/2003 | Ikezaki et al. | |

FOREIGN PATENT DOCUMENTS

| | | | |
|---|---|---|---|
| EP | 1199534 | A | 4/2002 |
| GB | 1 497 935 | | 1/1978 |
| GB | 2 198 220 | | 6/1988 |
| GB | 2 227 302 | | 7/1990 |
| JP | 4 263776 | | 9/1992 |
| JP | 4-295599 | A * | 10/1992 |
| JP | 6 159983 | | 6/1994 |
| JP | 10-160288 | A * | 6/1998 |
| JP | 2001050613 | A | 2/2001 |
| WO | 94/14021 | A | 6/1994 |

* cited by examiner

FLAT-TUBE EVAPORATOR WITH MICRO-DISTRIBUTOR

RELATED APPLICATIONS

Priority benefit is claimed to U.S. Provisional Patent Application Ser. No. 60/531,818, filed Dec. 22, 2003.

FIELD OF THE INVENTION

This invention relates generally to heat exchangers, and more particularly to evaporators.

BACKGROUND OF THE INVENTION

In conventional practice, supermarkets and convenience stores are equipped with refrigerated merchandisers, reach-in coolers, and/or unit coolers for presenting food and/or beverage products to customers while maintaining the food and/or beverage products in a refrigerated environment. Typically, cold, moisture-bearing air is provided to a product display area of the merchandiser, reach-in cooler, and/or unit cooler by passing an airflow over the heat exchange surface of an evaporator coil, or evaporator. A suitable refrigerant is passed through the evaporator to act as a heat exchange medium. The refrigerant absorbs heat from the airflow through the evaporator, and as the heat exchange takes place, the refrigerant evaporates while passing through the evaporator. As a result, the temperature of the airflow through the evaporator is lowered for introduction into the product display area of the merchandiser, reach-in cooler, and/or unit cooler.

SUMMARY OF THE INVENTION

The present invention provides, in one aspect, a flat-tube evaporator with a micro-distributor. The micro-distributor includes a tube having an inlet and an outlet comprised of a plurality of orifices in the tube. The tube is at least partially positioned in an inlet manifold of the flat-tube evaporator to enhance distribution of refrigerant from the tube to the inlet manifold of the flat-tube evaporator.

The present invention provides, in another aspect, a refrigeration system including one or more flat-tube evaporators connected in parallel, each having a micro-distributor. The refrigeration system may also include a distributor in a fluid series connection with the micro-distributors of the flat-tube evaporators.

Some embodiments of the present invention provide a flat-tube evaporator that can include an inlet manifold, an outlet manifold separated a distance from the inlet manifold, a distributor tube positioned within the inlet manifold and fluidly connected to a source of refrigerant, and a plurality of flat tubes fluidly connecting the inlet manifold and the outlet manifold. The distributor tube can include a plurality of orifices arranged in a substantially linear configuration along the length of the distributor tube, each of the plurality of orifices directing refrigerant into the inlet manifold in a first direction. Each of the plurality of flat tubes can define a second direction of fluid flow from the inlet manifold to the outlet manifold, the second direction being substantially opposite to the first direction.

In some embodiments, a flat-tube evaporator is provided. The flat-tube evaporator an include an inlet manifold, an outlet manifold separated a distance from the inlet manifold, a distributor tube positioned within the inlet manifold and in fluid communication with a refrigerant source, and a plurality of flat tubes positioned to fluidly connect the inlet manifold and the outlet manifold. The distributor tube can include a plurality of orifices through which refrigerant is directed into the inlet manifold. The plurality of orifices can be arranged to direct refrigerant into the inlet manifold in a first direction, wherein refrigerant is substantially only directed from the distributor tube into the inlet manifold in the first direction. The plurality of flat tubes can be positioned to direct the refrigerant from the inlet manifold to the outlet manifold in a second direction, the second direction being substantially opposite the first direction.

Some embodiments of the present invention provide a refrigeration system that can include a common distributor fluidly connected to a refrigerant source, and a plurality of flat-tube evaporators. Each of the plurality of flat-tube evaporators can include an inlet manifold, an outlet manifold separated a distance from the inlet manifold, a distributor tube positioned within the inlet manifold and fluidly connected to the common distributor, and a plurality of flat tubes positioned to fluidly connect the inlet manifold and the outlet manifold. The distributor tube can include a plurality of orifices positioned along the length of the distributor tube, each of the plurality of orifices positioned to direct the refrigerant into the inlet manifold in a first direction. Each of the plurality of flat tubes can be positioned to direct the refrigerant from the inlet manifold to the outlet manifold in a second direction, the second direction being substantially opposite the first direction.

Other features and aspects of the present invention will become apparent to those skilled in the art upon review of the following detailed description and drawings.

BRIEF DESCRIPTION OF THE DRAWINGS

In the drawings, wherein like reference numerals indicate like parts.

Figure 1:
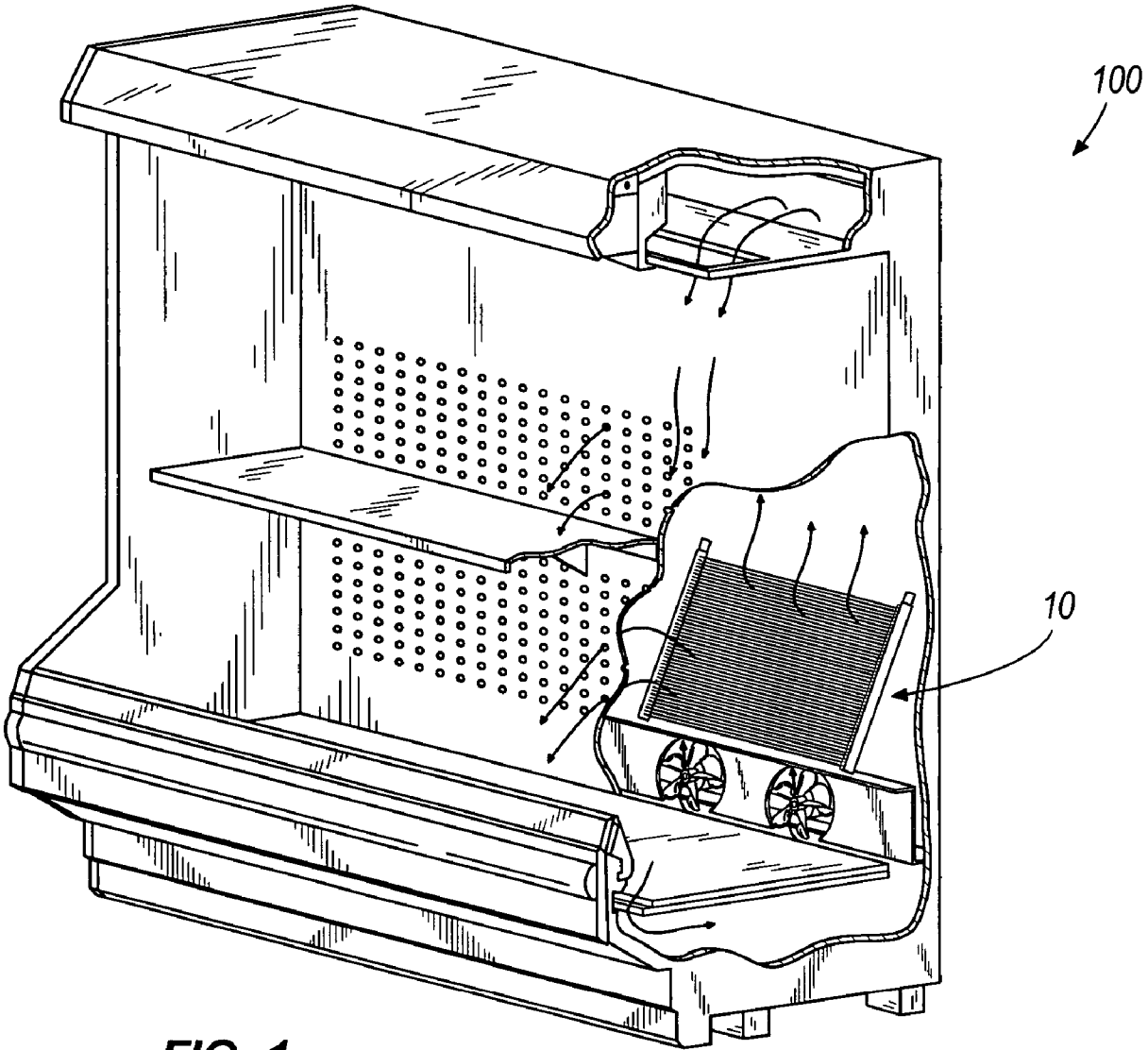
FIG. 1 is a perspective view of a refrigerated merchandiser utilizing a flat-tube evaporator.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Typically, refrigerated merchandisers, reach-in coolers, and/or unit coolers utilize long spans (upwards of 12') of round-tube plate-fin evaporators (not shown) to span the length of the refrigerated space of the refrigerated merchandisers, reach-in coolers, and/or unit coolers. The long spans of round-tube plate-fin evaporators may be replaced with one or more flat-tube evaporators 10 in an effort to improve upon the performance and/or efficiency of the refrigeration system of the refrigerated merchandisers, reach-in coolers, and/or unit coolers.

FIG. 1 illustrates an exemplary refrigerated merchandiser 100 utilizing the flat-tube evaporator 10. Although FIG. 1 illustrates the flat-tube evaporator 10 in one particular orientation in the merchandiser 100, such that refrigerant flows across the flat-tube evaporator 10 in a substantially horizontal direction, other constructions of the merchandiser 100 may orient the flat-tube evaporator 10 in any of a number of different orientations such that the refrigerant flows in any of a number of different directions. In addition, other constructions of the merchandiser 100 may also be employed with the flat-tube evaporator 10.

Generally, flat-tube evaporators 10 offer better performance than conventional round-tube plate-fin evaporators. For example, flat-tube evaporators 10 may achieve a refrigerant-side pressure drop as low as about 0.67 psi, compared to the 2 psi refrigerant-side pressure drop of conventional round-tube plate-fin evaporators. A lower refrigerant-side pressure drop allows the refrigerant to more easily move throughout the evaporator 10. Also, flat-tube evaporators 10 may achieve an air-side pressure drop as low as about 0.03 inwg (inches of water column gauge), compared to the 0.07 inwg pressure drop of conventional round-tube plate-fin evaporators. This may be accomplished by utilizing a flat-tube evaporator 10 having a relatively large face area. A lower air-side pressure drop allows the fan power to be reduced. Further, flat-tube evaporators 10 may allow for an approach temperature as low as about 1° F. The approach temperature is defined as the difference between the temperature of the discharged airflow and the saturation temperature of the refrigerant passing through the evaporator 10. Conventional round-tube plate-fin evaporators are less efficient than the flat-tube evaporator. As a result, the costs associated with operating a merchandiser 100 utilizing the flat-tube evaporator 10 may be substantially lower than the costs associated with operating a merchandiser utilizing a conventional round-tube plate-fin evaporator.

However, maldistribution of two-phase refrigerant in flat-tube evaporators 10 is an inherent problem. In other words, the refrigerant entering the flat-tube evaporator 10 via an inlet manifold 14 may be concentrated toward one end of the inlet manifold 14. As a result, the entire heat exchange surface of the flat-tube evaporator 10 may not be effectively utilized.

Figure 2:
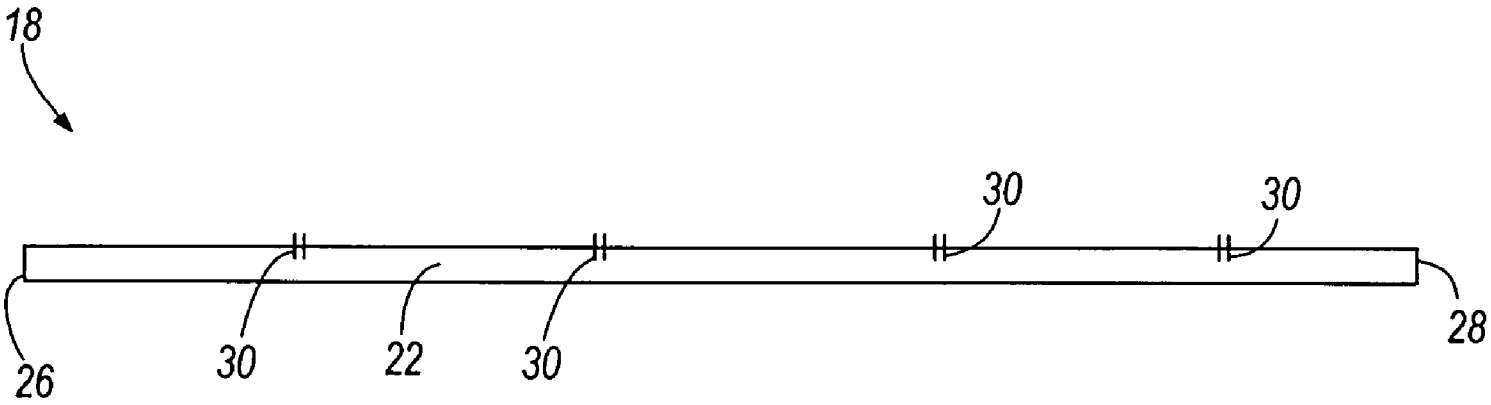
FIG. 2 is a plan view of a micro-distributor for use in the flat-tube evaporator, illustrating the flow of refrigerant from a plurality of orifices.
Figure 3:
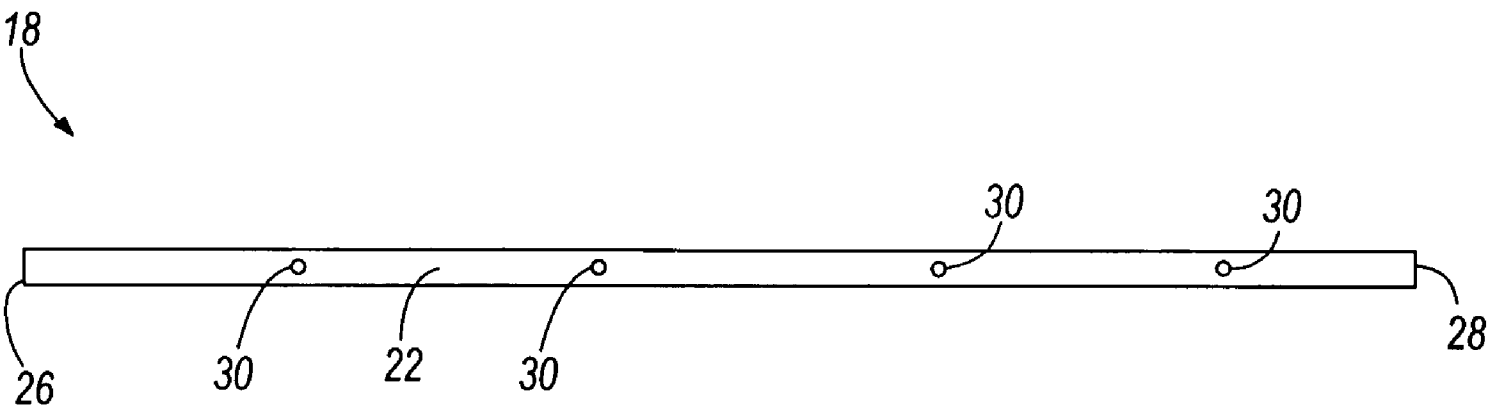
FIG. 3 is a side view of the micro-distributor of FIG. 2.

FIGS. 2 and 3 illustrate a distributor tube or micro-distributor 18 for use with flat-tube evaporators 10 in an effort to decrease the maldistribution of two-phase refrigerant in flat-tube evaporators 10. The micro-distributor 18 includes a tube 22 having an inlet 26 and an outlet comprised of a plurality of orifices 30 therein. It should be noted that the plurality of orifices 30 comprise a plurality of apertures, or holes in the tube 22. The lines corresponding with the orifices 30 are for reference purposes only and do not indicate any additional structure corresponding with the orifices 30. Alternatively, however, a plurality of outlets (e.g., straight-tubes, nozzles, diffusers, etc.) corresponding with the orifices 30 may be used.

Refrigerant may enter the tube 22 via the inlet 26, while an end 28 of the tube 22 opposite the inlet 26 may be blocked or closed to force discharge of the refrigerant through the orifices 30. The orifices 30 are sized appropriately to cause a pressure increase or build-up in the tube 22. The build-up of pressure in the tube 22 causes the refrigerant to substantially equally distribute along the length of the tube 22. The tube 22 and orifices 30 are also sized appropriately to reduce the amount of separation of vapor refrigerant and liquid refrigerant in the two-phase flow.

In the illustrated construction, the orifices 30 are aligned in the tube 22 in a substantially linear configuration. However, alternate constructions of the micro-distributor 18 may include orifices 30 in the tube 22 in a curvlinear configuration, or orifices 30 substantially arranged about the circumference of the tube 22 in any of a number of different patterns or random configurations. Also, in the illustrated construction, the orifices 30 are substantially equally-spaced from one another. However, alternate constructions of the micro-distributor 18 may include orifices 30 having different concentrations or spacing along the length of the tube 22.

In the illustrated construction, the tube 22 utilizes a relatively small diameter (i.e., an internal diameter) of about 3/16" to 1/4". However, in another construction of the micro-distributor 18, the tube 22 may have a diameter of at least about 1/4". In yet another construction of the micro-distributor 18, the tube 22 may have a diameter of at least about 1/8". Further, in another construction of the micro-distributor 18, the tube 22 may have a diameter less than about 1/2". In yet another construction of the micro-distributor 18, the tube 22 may have a diameter less than about 1/4". Alternate constructions of the micro-distributor 18 may also include a tube 22 having a non-circular cross-sectional shape of nominal size corresponding to the circular cross-sectional tube 22.

Also, in the illustrated construction, the micro-distributor 18 includes orifices 30 having a diameter of about 0.032". However, in another construction of the micro-distributor 18, the orifices 30 may have a diameter of at least about 0.020". In yet another construction of the micro-distributor 18, the orifices 30 may have a diameter of at least about 0.050". Further, in another construction of the micro-distributor 18, the orifices 30 may have a diameter less than about 0.150". In yet another construction of the micro-distributor 18, the orifices 30 in the tube 22 may have a diameter less than about 0.050". Alternate constructions of the micro-distributor 18 may also include orifices 30 having a non-circular shape of nominal size corresponding to the circular orifices 30.

Figure 4:
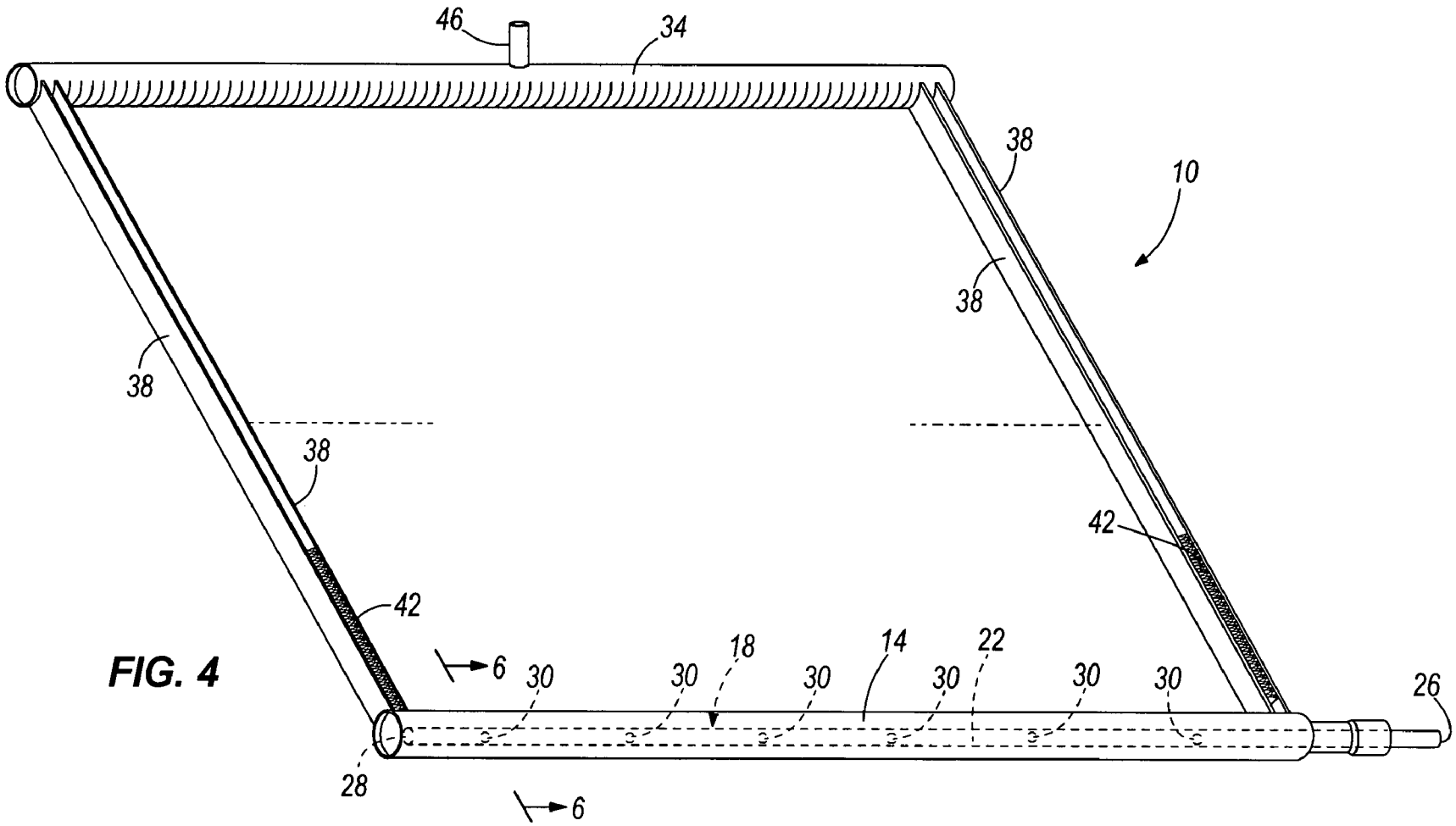
FIG. 4 is a perspective view of the micro-distributor of FIG. 2 positioned in an inlet manifold of the flat-tube evaporator.

FIG. 4 illustrates the micro-distributor 18 positioned substantially in the inlet manifold 14 of the flat-tube evaporator 10. Portions of the flat-tube evaporator 10 (e.g., the flat tubes and fins) are substantially removed for purposes of clarity.

Figure 6:
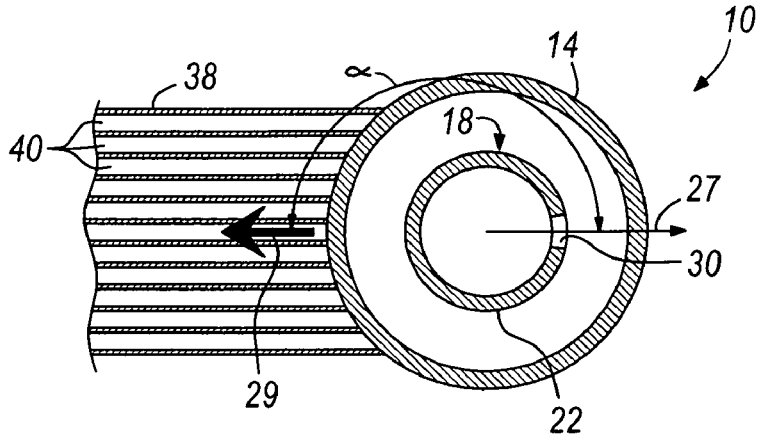
FIG. 6 is a cross-sectional view of the flat-tube evaporator of FIG. 4, taken along line 6—6.

The inlet manifold 14 is substantially sealed such that refrigerant is fed to the micro-distributor 18, and discharged from the micro-distributor 18 via the orifices 30 into the inlet manifold 14. The flat-tube evaporator 10 also includes an outlet manifold 34 fluidly connected to the inlet manifold 14 by a plurality of flat tubes 38. The flat-tubes 38 may be formed to include a plurality of internal passageways, or microchannels 40 (as shown in FIG. 6), that are much smaller in size than the internal passageway of the coil in a round-tube plate-fin evaporator. As used herein, the flat tubes 38 may also comprise mini multi-port tubes, or micro multi-port tubes (otherwise known as microchannel tubes). However, in other constructions of the flat tubes 38, the tubes 38 may include only one channel, or internal passageway. In the illustrated construction, the flat tubes 38, the inlet manifold 14, and the outlet manifold 34 are made from a highly conductive metal such as aluminum, however other highly conductive metals may also be used. Further, the flat tubes 38 are coupled to the inlet manifold 14 and the outlet manifold 34 by a brazing process, however, a welding process may also be used.

The microchannels 40 allow for more efficient heat transfer between the airflow passing over the flat-tubes 38 and the refrigerant carried within the microchannels 40, compared to the airflow passing over the coil of the round-tube plate-fin evaporator. The microchannels 40 may be configured with rectangular cross-sections (as shown in FIG. 6), although other constructions of the flat tubes 38 may have microchannels 40 of other cross-sections.

The flat tubes 38 may be separated into about 12 to 15 microchannels 40, with each microchannel 40 being about 1.5 mm in height and about 1.5 mm in width, compared to a diameter of about 9.5 mm (⅜") to 12.7 mm (½") for the internal passageway of a coil in a round-tube plate-fin evaporator. However, in other constructions of the flat tubes 38, the microchannels 40 may be as small as 0.5 mm by 0.5 mm, and as large as 4 mm by 4 mm. In the illustrated construction, the flat-tubes 38 may be about 22 mm wide. However, in other constructions, the flat tubes 38 may be as wide as 127 mm, or as narrow as 18 mm. Further, the spacing between adjacent flat tubes 38 may be about 9.5 mm. However, in other constructions, the spacing between adjacent flat tubes 38 may be as much as 16 mm, or as little as 3 mm.

The tube 22, the orifices 30, and/or the microchannels 40 in the flat-tubes 38 may be appropriately sized to provide a desired flow rate of refrigerant in the refrigeration system. As such, certain relationships and/or ratios between the tube 22 and orifices 30, the orifices 30 and microchannels 40, and the tube 22 and microchannels 40, among others, may be desirable over others to achieve a desired flow rate of refrigerant in the refrigeration system. For example, a preferred range of ratios between the diameter of the tube 22 and the diameter of the orifices 30 may be between about 3:1 to about 10:1.

As shown in FIG. 4, the flat-tube evaporator 10 includes a plurality of louver fins 42 coupled to and positioned along the flat tubes 38. The fins 42 may be coupled between adjacent flat tubes 38 by a brazing or welding process. The fins 42 are made from a highly conductive metal such as aluminum, like the flat tubes 38 and the inlet and outlet manifolds 14, 34. The brazed assembly including the flat tubes 38, the inlet and outlet manifolds 14, 34, and the fins 42 forms a brazed aluminum construction. In the illustrated construction, the louver fins 42 are configured in a V-shaped pattern and include a plurality of louvers (not shown) formed in the fins 42. In the illustrated construction, the fin density along the flat tubes 38 may be about 16 fins per inch. However, in other constructions, the fin density along the flat tubes 38 may be as low as 6 fins per inch, and as high as 18 fins per inch. In yet other constructions, the fin density along the flat tubes 38 may be as high as 25 fins per inch.

Generally, the fins 42 aid in the heat transfer between the airflow passing through the flat-tube evaporator 10 and the refrigerant carried by the flat tubes 38. The increased efficiency of the flat-tube evaporator 10 is due in part to such a high fin density, compared to the fin density of 2 to 4 fins per inch of the round-tube plate-fin evaporator. The increased efficiency of the flat-tube evaporator 10 is also due in part to the louvers, which provide a plurality of leading edges to redirect the airflow through and around the fins 42. As a result, heat transfer between the fins 42 and the airflow is increased. Further, the high air-side heat transfer of the louver fins 42 and the high refrigerant-side heat transfer of the flat tubes 38, along with minimal contact resistance of the brazed aluminum construction, yields the highly efficient, and high-performance flat-tube evaporator 10.

As shown in FIGS. 4 and 6, the micro-distributor 18 is shown oriented in the inlet manifold 14 such that the plurality of orifices 30 are in a non-facing relationship with the inlets of the respective microchannels 40 of the flat tubes 38, such that the orifices 30 discharge refrigerant from the tube 22 against the interior side wall of the inlet manifold 14, causing the refrigerant to substantially equally distribute throughout the inlet manifold 14. As a result, the individual flat tubes 38 of the evaporator 10 may receive substantially equal amounts of refrigerant.

Specifically, angle $\alpha$ in FIG. 6 represents the angle between the direction of fluid flow out of the orifices 30, as represented by arrow 27, and the macroscopic direction of fluid flow through the flat tubes 38, as represented by arrow 29. As used herein and in the appended claims, positioning orifices 30 in a "non-facing" relationship with the inlets of the respective microchannels 40 refers to orienting the direction 27 at an angle $\alpha$ with respect to the direction 29 that is not equal to zero degrees. More particularly, the angle $\alpha$ in a "non-facing" relationship is greater than about zero degrees and less than about 360 degrees.

Figure 7:
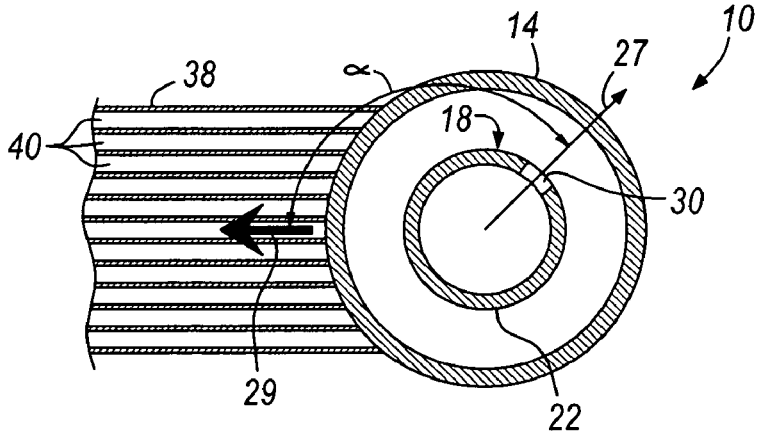
FIG. 7 is a cross-sectional view of a flat-tube evaporator according to another embodiment of the invention.
Figure 8:
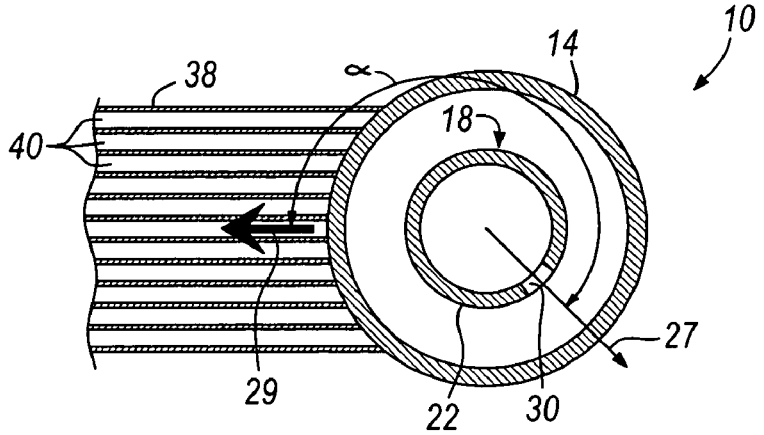
FIG. 8 is a cross-sectional view of a flat-tube evaporator according to another embodiment of the invention.

In some embodiments, the direction 27 is oriented directly opposite (i.e., the angle $\alpha$ is about 180 degrees, as shown in FIG. 6) the direction 29. In some embodiments, the direction 27 is oriented substantially opposite (i.e., the angle $\alpha$ is greater than about 90 degrees and less than about 270 degrees) the direction 29. In some embodiments, the direction 27 is oriented with respect to the direction 29 at an angle $\alpha$ ranging from about 135 degrees (as shown in FIG. 7) to about 225 degrees (as shown in FIG. 8).

In some embodiments, as described above, the orifices 30 are not aligned in the tube 22 in a substantially linear configuration, but are arranged in a different configuration about the circumference of the tube 22. In such embodiments, each orifice 30 directs the refrigerant into the inlet manifold 14 at an angle $\alpha$, and one or more of the orifices 30 directs the refrigerant at a different angle $\alpha$. For example, in some embodiments, angle $\alpha$ increases for each orifice 30 from one end of the tube 22 to another. In some embodiments, each orifice 30 directs the refrigerant into the inlet manifold 14 at an angle $\alpha$, and the plurality of orifices 30 directs the refrigerant at substantially the same angle $\alpha$.

From the inlet manifold 14, refrigerant passes through the flat tubes 38 and is discharged into the outlet manifold 34 in substantially gaseous form. From the outlet manifold 34, the refrigerant may be discharged from the evaporator 10 via an outlet 46 in the outlet manifold 34, and drawn into the suction side of a compressor (not shown) in the refrigeration system for re-processing.

Figure 5:
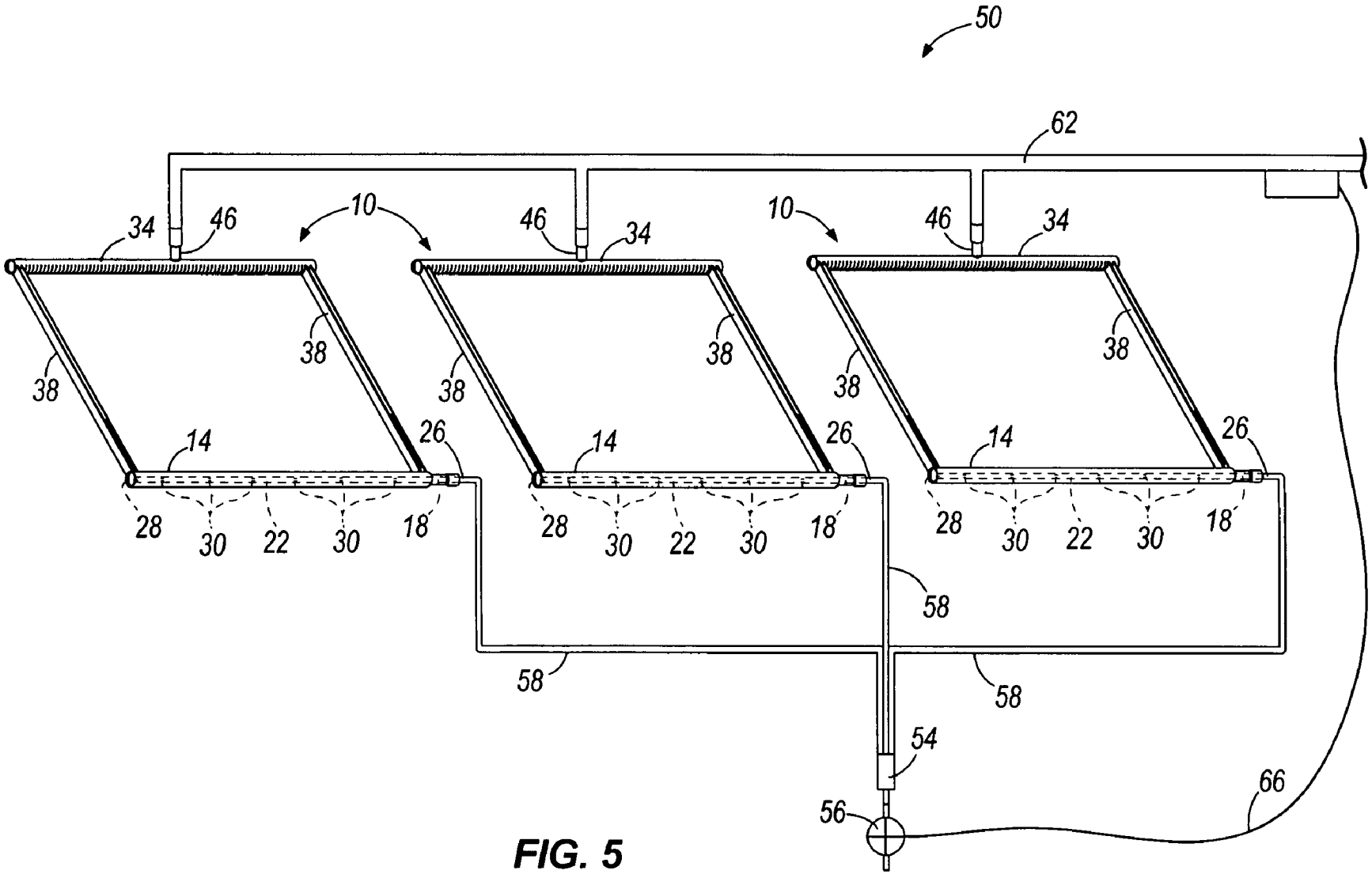
FIG. 5 is a perspective view of a plurality of flat-tube evaporators connected in parallel, each flat-tube evaporator having a micro-distributor of FIG. 2 connected in series with a distributor.

FIG. 5 illustrates a plurality of flat-tube evaporators 10 arranged in a fluid parallel assembly 50. Such an assembly 50 may be applicable in a refrigerated merchandiser, reach-in cooler, and/or unit cooler to replace a single, long, and conventional round-tube plate-fin evaporator. Since the refrigeration load across the length of the refrigerated space of a refrigerated merchandiser, reach-in cooler, and/or a unit cooler is relatively non-varying, the flow of refrigerant to all of the flat-tube evaporators 10 may be divided by a distributor 54 and modulated by a single expansion valve 56 upstream of the distributor 54. The distributor 54 may be configured as any known distributor 54 in the art and sized to provide a desired pressure drop across the distributor 54. However, alternate constructions of the refrigeration system may utilize a dedicated expansion valve 56 for each flat-tube evaporator 10. Dedicated expansion valves 56 provide the opportunity for increased temperature control such as when the refrigeration load varies from evaporator 10 to evaporator 10 (i.e., cooling zone to cooling zone) in the merchandiser 100.

As shown in FIG. 5, the micro-distributors 18 of the respective flat-tube evaporators 10 are fluidly connected in series with the distributor 54 via a plurality of inlet headers 58. Like the distributor 54, the micro-distributors 18 may provide a desired pressure drop of the refrigerant flowing into each of the respective flat-tube evaporators 10. As a result, a portion of the pressure drop from the high-pressure side of the refrigeration system to the low-pressure side of the refrigeration system may be provided by the distributor 54 and/or micro-distributors 18, while the remaining portion may be provided by the expansion valve 56.

Refrigerant may exit the flat-tube evaporators 10 via the respective outlets 46 to a common outlet header 62, which may be fluidly connected to the suction side of the compressor. In the illustrated construction, the expansion valve 56 can modulate the refrigerant flow with superheat feedback 66 from the outlet header 62. Alternatively, the superheat feedback 66 may be taken at a location between the outlets 46 of the respective flat-tube evaporators 10 and the common outlet header 62.

Although the illustrated flat-tube evaporators 10 are shown in a fluid parallel assembly 50, the flat-tube evaporators 10 with respective micro-distributors 18 may be arranged in any of a number of different module configurations, which, in turn, may be arranged in either a fluid parallel assembly 50 or a fluid series assembly.

Various features and aspects are set forth in the following claims.

The invention claimed is:

1. A flat-tube evaporator comprising:

an inlet manifold;

an outlet manifold separated a distance from the inlet manifold;

a distributor tube positioned within the inlet manifold and fluidly connected to a source of refrigerant, the distributor tube including a plurality of orifices arranged in a substantially linear configuration along the length of the distributor tube, each of the plurality of orifices directing refrigerant into the inlet manifold in a first direction; and a plurality of flat tubes fluidly connecting the inlet manifold and the outlet manifold, each of the plurality of flat tubes defining a second direction of fluid flow from the inlet manifold to the outlet manifold, the second direction being substantially opposite to the first direction.

2. The flat-tube evaporator of claim 1, wherein refrigerant is substantially only directed from the distributor tube into the inlet manifold in the first direction.

3. The flat-tube evaporator of claim 1, wherein the second direction is directly opposite the first direction.

4. The flat-tube evaporator of claim 1, wherein the second direction is oriented at an angle with respect to the first direction, and wherein the angle ranges from about 135 degrees to about 225 degrees.

5. The flat-tube evaporator of claim 4, wherein the angle is about 180 degrees.

6. The flat-tube evaporator of claim 1, wherein the inlet manifold has a diameter of less than about ½".

7. The flat-tube evaporator of claim 1, wherein the inlet manifold has a diameter of at least about ⅛".

8. The flat-tube evaporator of claim 1, wherein each of the plurality of orifices has a diameter of at least about 0.020".

9. The flat-tube evaporator of claim 1, wherein each of the plurality of orifices has a diameter of less than about 0.150".

10. The flat-tube evaporator of claim 1, wherein the plurality of flat tubes includes a plurality of microchannels.

11. The flat-tube evaporator of claim 1, wherein the inlet manifold has a first diameter and each of the plurality of orifices has a second diameter, and wherein the ratio of the first diameter to the second diameter ranges from about 3:1 to about 10:1.

12. A flat-tube evaporator comprising:

an inlet manifold;

an outlet manifold separated a distance from the inlet manifold;

a distributor tube positioned within the inlet manifold and in fluid communication with a refrigerant source, the distributor tube including a plurality of orifices through which refrigerant is directed into the inlet manifold, the plurality of orifices arranged to direct refrigerant into the inlet manifold in a first direction, wherein refrigerant is substantially only directed from the distributor tube into the inlet manifold in the first direction; and a plurality of flat tubes positioned to fluidly connect the inlet manifold and the outlet manifold, the plurality of flat tubes positioned to direct the refrigerant from the inlet manifold to the outlet manifold in a second direction, the second direction being substantially opposite the first direction.

13. A refrigeration system comprising:

a common distributor fluidly connected to a refrigerant source;

a plurality of flat-tube evaporators, each of the plurality of flat-tube evaporators including an inlet manifold, an outlet manifold separated a distance from the inlet manifold;

a distributor tube positioned within the inlet manifold and fluidly connected to the common distributor, the distributor tube including a plurality of orifices positioned along the length of the distributor tube, each of the plurality of orifices positioned to direct the refrigerant into the inlet manifold in a first direction;

a plurality of flat tubes positioned to fluidly connect the inlet manifold and the outlet manifold, each of the plurality of flat tubes positioned to direct the refrigerant from the inlet manifold to the outlet manifold in a second direction, the second direction being substantially opposite the first direction.

14. The refrigeration system of claim 13, wherein the plurality of flat-tube evaporators are connected in a fluid parallel configuration.

15. The refrigeration system of claim 13, further comprising an expansion valve positioned upstream of the common distributor.

16. The refrigeration system of claim 13, further comprising a plurality of expansion valves positioned downstream of the common distributor, each of the plurality of expansion valves being in fluid communication with one of the plurality of flat-tube evaporators.

17. The refrigeration system of claim 13, wherein the plurality of orifices in at least one of the distributor tubes is aligned in a substantially linear configuration.

18. The refrigeration system of claim 13, wherein the second direction is oriented at an angle with respect to the first direction, and wherein the angle ranges from about 135 degrees to about 225 degrees.

19. The refrigeration system of claim 18, wherein the angle is about 180 degrees.

20. The refrigeration system of claim 13, wherein the refrigerant is substantially only directed from the distributor tube into the inlet manifold in the first direction.

* * * * *